US012800155B2

(12) United States Patent
Shimel et al.

(10) Patent No.: US 12,800,155 B2
(45) Date of Patent: Nov. 17, 2026

(54) IMPINGEMENT OVEN WITH FOCUSED AND DIFFUSE JETS

(71) Applicant: Alto-Shaam, Inc., Menomonee Falls, WI (US)

(72) Inventors: Joshua J. Shimel, Waukesha, WI (US); Jon Paul Flick, Wales, WI (US); Craig Douglas Burnett, Slinger, WI (US); Benjamin J. Mavis, Kewaskum, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 368 days.

(21) Appl. No.: 18/406,791

(22) Filed: Jan. 8, 2024

(65) Prior Publication Data

US 2024/0230109 A1 Jul. 11, 2024

Related U.S. Application Data

(60) Provisional application No. 63/450,716, filed on Mar. 8, 2023, provisional application No. 63/438,089, filed on Jan. 10, 2023.

(51) Int. Cl.
*F24C 15/00* (2006.01)
*F24C 15/32* (2006.01)
*F24C 15/34* (2006.01)

(52) U.S. Cl.
CPC ..... *F24C 15/322* (2013.01); *F24C 15/008* (2013.01); *F24C 15/34* (2013.01)

(58) Field of Classification Search
CPC ..... F24C 15/322; F24C 15/008; F24C 15/34
USPC ..... 126/21 A
See application file for complete search history.

(56) References Cited

U.S. PATENT DOCUMENTS 4,338,911 A * 7/1982 Smith ..... A23B 2/05 426/456
5,042,458 A 8/1991 Spencer et al.
5,185,172 A * 2/1993 Barkhau ..... A21B 1/245 426/468
5,818,014 A * 10/1998 Smith ..... H05B 6/6408 219/679
6,376,817 B1 * 4/2002 McFadden ..... H05B 6/704 219/400
6,933,473 B2 8/2005 Henke et al.
(Continued)

FOREIGN PATENT DOCUMENTS

CN 107049049 8/2017
CN 208610654 U * 3/2019
(Continued)

OTHER PUBLICATIONS

Mar. 19, 2019 Wang et al.[CN208610654] text document.*

*Primary Examiner* — Avinash A Savani
(74) *Attorney, Agent, or Firm* — Wong Meyer Smith & McConnell

(57) ABSTRACT

An impingement oven provides a mixture of focused jets and diffuse flow jets to produce a balance between high-speed cooking and uniform food surface heating without the need to move the food during the cooking process. A combination of focused jets, providing high-speed focused airflow for impingement cooking, interspersed with diffuse jets, providing dispersed flow, may interact with the focused jets to moderate the effect of the focused jets near the food surface.

18 Claims, 7 Drawing Sheets

(56) References Cited

U.S. PATENT DOCUMENTS

| | | | | |
|---|---|---|---|---|
| 7,252,407 | B2 | 8/2007 | Lewis | |
| 9,615,691 | B2 | 4/2017 | Yan | |
| 10,624,353 | B1 * | 4/2020 | Langley | F24C 3/04 |
| 11,092,343 | B2 | 8/2021 | Raghavan et al. | |
| 2006/0157479 | A1 * | 7/2006 | Claesson | H05B 6/642 219/681 |
| 2008/0206420 | A1 * | 8/2008 | McFadden | A23L 5/17 219/385 |
| 2009/0316385 | A1 * | 12/2009 | Weber | F21K 9/61 362/310 |
| 2011/0083657 | A1 * | 4/2011 | Ploof | F24C 15/322 126/21 A |
| 2014/0202444 | A1 * | 7/2014 | Dobie | F24C 15/322 219/400 |
| 2017/0146255 | A1 | 5/2017 | Smith | |
| 2018/0031250 | A1 * | 2/2018 | McKee | F24C 15/322 |
| 2018/0094820 | A1 * | 4/2018 | Verdoliva | F24C 15/025 |
| 2022/0010968 | A1 * | 1/2022 | McKee | F24C 15/322 |

FOREIGN PATENT DOCUMENTS

| | | |
|---|---|---|
| CN | 211260896 | 8/2020 |
| CN | 212261138 | 1/2021 |
| JP | 2005-155962 | 6/2005 |
| WO | 2000064219 | 10/2000 |

* cited by examiner

IMPINGEMENT OVEN WITH FOCUSED AND DIFFUSE JETS

CROSS REFERENCE TO RELATED APPLICATIONS

This application claims the benefit of U.S. Provisional Patent Application No. 63/438,089, filed Jan. 10, 2023, and U.S. Provisional Patent Application No. 63/450,716, filed Mar. 8, 2023, which are incorporated by reference herein in their entireties.

BACKGROUND OF THE INVENTION

The present invention relates to food preparation ovens and, in particular, to impingement ovens using jets of heated air for rapid cooking of food items.

Conventional ovens cook food by conduction of heat into the food from surrounding heat or by radiation (during broiling or the like) from a heated element. The former conductive heating provides a slower and more uniform heating of the food throughout its volume whereas the radiated heat provides a high temperature-gradient cooking that can crisp or brown the outer surface of the food.

Convection and combi ovens increase the conductive heating of the food by circulating heated air with fans to disperse insulating layers of air that can form around food and by increasing the specific heat of the air through the addition of steam.

Impingement ovens direct jets of heated air directly at the food increasing the heat transfer over that of conventional or convection ovens. One drawback to impingement ovens is that the concentrated heating at the focus of the air jets can create undesirable patterns of localized browning (spots) and, more fundamentally, uneven cooking. In order to overcome this drawback, it is common to move the food during cooking, for example, on a reciprocating tray, so as to even out the cooking over the surface of the food. Mechanisms for moving the heated tray in the environment of the oven add complexity to the oven and can reduce its reliability.

SUMMARY OF THE INVENTION

The present invention provides an impingement oven providing even food cooking without movement of the food in the oven cavity, through a combination of focused jets, providing high-speed focused airflow for impingement cooking, interspersed with diffuse jets, providing dispersed flow that may interact with the focused jets to moderate the effect of the focused jets near the food surface.

More specifically, in one embodiment, the invention provides an oven having at least one oven cavity sealable by a door to provide a lower sheet metal wall and opposed upper sheet metal wall separated by vertical sidewalls including a sidewall formed by the door, the upper wall providing an upper plenum receiving air at a plenum entrance and conducting that air to a plurality of openings distributed over a lower surface of the upper plenum, and the lower wall providing a lower plenum receiving air at a plenum entrance and conducting that air to a plurality of openings distributed over an upper surface of the lower plenum. A fan receives air from the air cavity and blows the air into the plenum for discharge through the openings of the upper sheet metal wall and lower sheet metal wall, and a heater heats the air before discharge through the openings. The openings of the upper sheet metal wall and lower sheet metal wall include focused jet openings and diffuse jet openings, where the sheet metal at the focused jet openings only is deformed to extend along an axis of air flow through the focused jet openings to promote a first airflow narrower than a second airflow through the diffuse jet openings.

It is thus a feature of at least one embodiment of the invention to provide a simple method of moderating the heat intensity of impingement jets to provide more even cooking without the need to move the food during the cooking process.

The focused jet openings may be funnel-shaped, converging at the focused jet opening, and the sheet metal at the diffuse jet openings may be substantially perpendicular to an axis of airflow through the diffuse jet openings.

It is thus a feature of at least one embodiment of the invention to provide a jet plate that can be readily formed by standard metal forming techniques, for example, as dimpled by a press.

The diffuse jet openings may be interspersed among the focused jet openings.

It is thus a feature of at least one embodiment of the invention to allow flexible adjustment of the airflow pattern by interspersing the focused jet openings and diffuse jet openings among each other.

The diffuse jet openings may be slots.

It is thus a feature of at least one object of the invention to provide high flow diffuse jet openings while preserving sufficient back pressure to operate the focused jet openings.

In one embodiment, the oven may provide a return air conduit communicating between intake openings proximate to the front of the oven in one of the lower sheet metal wall and upper sheet metal wall and a return of the impingement jet fan to operate in conjunction with discharge openings opposite the intake openings and discharging air into the oven, the intake openings and discharge openings operating together to provide an air curtain limiting the escape of hot air from the oven cavity when the door is open.

It is thus a feature of at least one embodiment of the invention to employ the same fan used for impingement heating to provide an air curtain thereby simplifying the provision of an air curtain reducing heat loss when the door is opened.

The intake openings may be in the lower sheet metal wall.

It is thus a feature of at least one embodiment of the invention to provide a downward directed air curtain where heat spillage is shielded by the open door.

The return air conduit may pass along an oven sidewall.

It is thus a feature of at least one embodiment of the invention to incorporate an air curtain into an impingement oven without interference with the plenums delivering impingement air.

The oven may further include a valve actuated by the door to block the intake openings when the door is closed.

It is thus a feature of at least one embodiment of the invention to avoid interference between the impingement jets and the air curtain during normal operation of the oven.

The sheet metal at the discharge openings may be deformed to extend along an axis of airflow through the discharge openings to promote focused airflow.

It is thus a feature of at least one embodiment of the invention to employ focused air jets for the air curtain for improved air curtain control.

In one embodiment, the oven may provide an oven housing surrounding the oven cavity and provide upstanding sidewalls spaced from the vertical sidewalls of the oven cavity to define an air conduit therethrough. A second fan communicates with the air conduit to draw ambient air therethrough to scavenge heat received by that conduit.

It is thus a feature of at least one embodiment of the invention to minimize the thickness of the sidewalls while providing a strong thermal barrier through the use of active insulation implemented by a flow of cooling ambient air through sidewall channels.

The oven may further include intake openings to the conduit positioned at a front of the oven housing proximate to the door whereby the second fan draws air from a front of the oven housing and discharges the air at the rear of the oven housing.

It is thus a feature of at least one embodiment of the invention to minimize and dissipate heating of the work area in front of the oven.

The oven may include an insulating fiber material positioned between the vertical sidewalls of the oven cavity and the conduit.

It is thus a feature of at least one embodiment of the invention to maximize the effect of the active cooling by placing it outside of any passive insulation to work with lower heat loads.

The second fan may provide a motor positioned within airflow generated by the fan.

It is thus a feature of at least one embodiment of the invention to provide a quiet and efficient in-line motor fan possible because of the low temperature of the vent air.

In one embodiment, a light pipe may be positioned with the first end exposed in the oven cavity and the second end exposed outside of the thermal insulation, and an LED may be positioned to direct light into the first end of the light pipe whereby the LED is insulated from the high temperature of the oven cavity.

It is thus a feature of at least one embodiment of the invention to employ energy-efficient LED lighting while observing the low maximum temperature ratings of such devices.

The light pipe may be a straight glass rod extending along an axis between the first end and a second end, and the first end and second end may present surfaces perpendicular to that axis.

It is thus a feature of at least one embodiment of the invention to maximize light coupling to the light pipe in an extremely simple structure.

The LED may be spaced from the second end by an air gap.

It is thus a feature of at least one embodiment of the invention to employ a material such as glass for the light pipe that may block airflow but may be in itself thermally conductive.

The second end of the light pipe may be attached to a heatsink dispersing heat from the second end.

It is thus a feature of at least one embodiment of the invention to dissipate heat from the end of the light pipe proximate to the LED.

The LED may be an LED attached to a second heatsink separate from the heatsink.

It is thus a feature of at least one embodiment of the invention to provide separate heat conduction paths for oven heat versus heat generated by operation of the LED.

These particular objects and advantages may apply to only some embodiments falling within the claims and thus do not define the scope of the invention.

DETAILED DESCRIPTION OF THE PREFERRED EMBODIMENT

Figure 1:
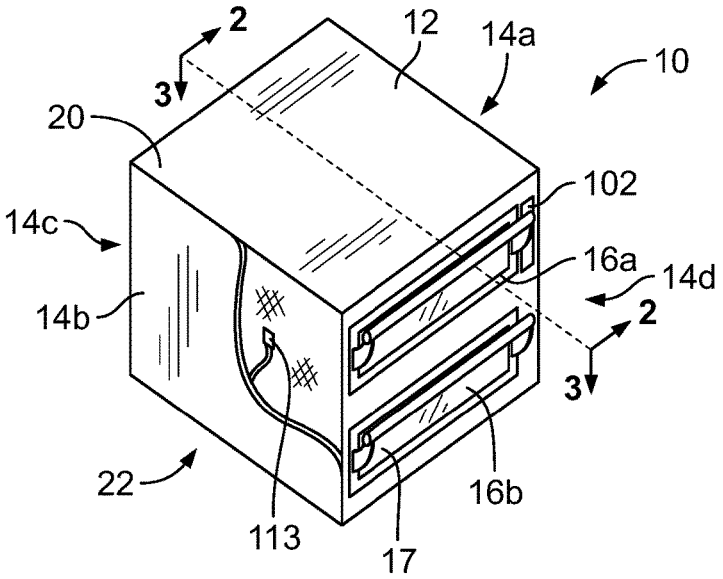
FIG. 1 is a perspective view of an oven showing two stacked oven modules each having a front door and showing in cutaway a LED illuminator.

Referring now to FIG. 1, a multi-cavity oven 10 may provide for an outer housing 12 having upstanding sidewalls 14 including left and right sidewalls 14*a* and 14*b*, rear sidewall 14*c*, and front sidewall 14*d*. The sidewalls 14 extend between upper wall 20 and lower wall 22 completing a parallelepiped enclosure. The front sidewall 14*d* may provide oven doors 16*a* and 16*b* that may be opened to access respective oven cavities 40 (shown in FIG. 2). The cavities 40 behind each of the doors 16*a* and 16*b* are substantially identical and accordingly henceforth a single cavity 40 will be described being representative of both.

Each of the doors 16 may include a glass panel 17 allowing viewing of the interior of the oven cavities 40 and may pivot downward about a horizontal axis at its bottom edge against the force of a spring or counterweight to provide bistability. Generally, the oven cavity 40 may be limited in height, for example, being less than one-foot tall to provide improved impingement cooking from reduced jet dispersal.

Figure 2:
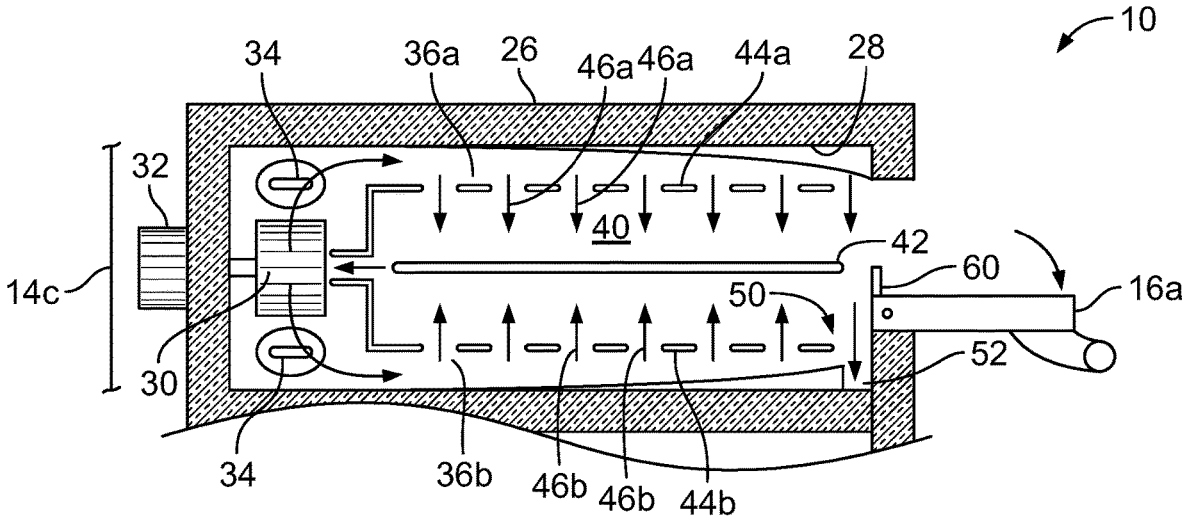
FIG. 2 is a cross-section along line 2-2 of FIG. 1 showing impingement airflow and an air curtain when the door is open.
Figure 3:
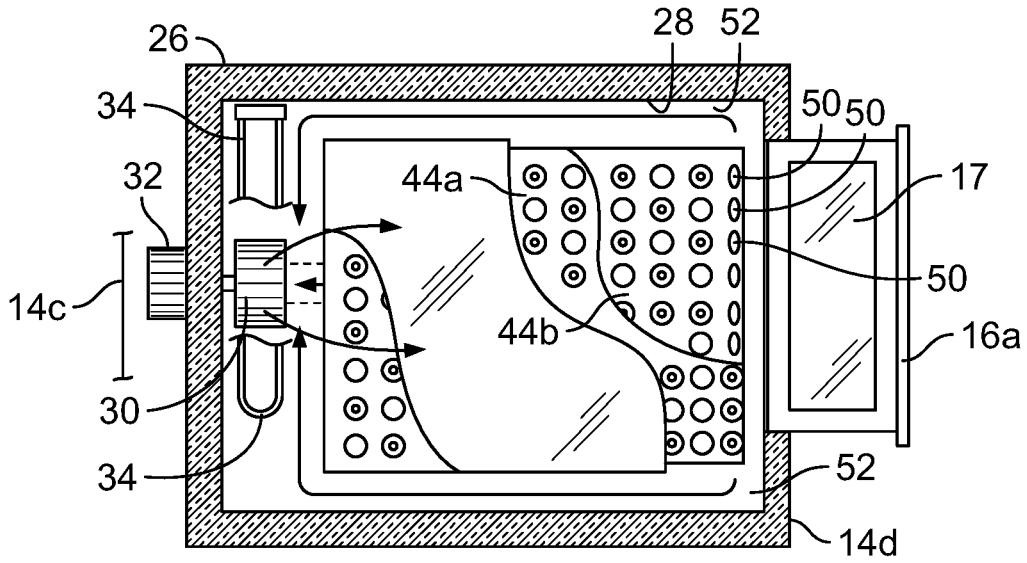
FIG. 3 is a cross-section taken along line 3-3 of FIG. 1 showing the return airflow from the air curtain along a sidewall of the oven.

Referring also to FIGS. 2 and 3, each cavity 40 may provide for thermal insulation 26, for example, a fiber insulator such as fiberglass or the like surrounding a cavity inner housing 28, the latter being, for example, constructed of sheet metal, providing structure to the cavity and support of the various components to be described. In one example, the thermal insulation 26 may be one inch of fiberglass mat with a reflective aluminum foil providing a thermal resistance R-value of R3 to R4 (one-inch material having a k-value of approximately 0.04 W/mK).

A rear wall of the cavity inner housing 28 may support a squirrel cage fan 30 driven by a motor 32 outside of the thermal insulation 26 but within the rear sidewall 14*c*. The fan 30 drives air past heaters 34 into an upper manifold 36*a* and lower manifold 36*b* extending both above and below the oven cavity 40 to flank a rack 42 for holding food to be cooked. The lower side of the upper manifold 36*a* provides an upper jet plate 44*a* having openings to generate a series of downwardly extending jets 46*a* passing into the cooking cavity 40. The upper jet plate 44*a* provides the upper surface of the cooking cavity 40.

Similarly, the upper side of the lower manifold 36*b* provides a lower jet plate 44*b* having openings to generate a series of upwardly extending jets 46*b* passing into the cooking cavity 40, the lower jet plate 44*b* providing the lower surface of the cooking cavity 40. The rack 42 is generally a wire rack opening to allow direct impingement of the jets 46*b* directly on the food.

A front edge of the lower jet plate 44*b* provides for a set of intake openings 50 that do not communicate with the lower manifold 36*b* but rather communicate with a return channel 52 passing along the left and right sides of the oven outside of the cooking cavity 40 but within the thermal insulation 26. The fan 30 receives air from the cooking cavity 40 as replenished by the jets 46 through a rear wall 54 of the cooking cavity 40 and also through the channels 52.

Referring particularly to FIG. 2, the combination of frontmost impingement openings 45 on the upper jet plate 44*a* and the intake openings 50 on the lower jet plate 44*b* provides an air curtain airflow 56 being a continuous sheet of downwardly flowing air across the opening of the cooking cavity 40 and serving to prevent the escape of hot air when the door 16 is open as depicted. Generally, the openings 15 on the upper jet plate 44*a* serving as discharge openings may be focused jet openings as will be discussed in greater detail below.

When the door 16 is closed (pivoted vertically from its depicted position), a vent hole closure flap 60 attached to the door 16 may move downward to cover the intake openings 50 so as to reduce distortions in airflow that may be caused by air drawn into the intake openings 50 during the cooking process.

Figure 4:
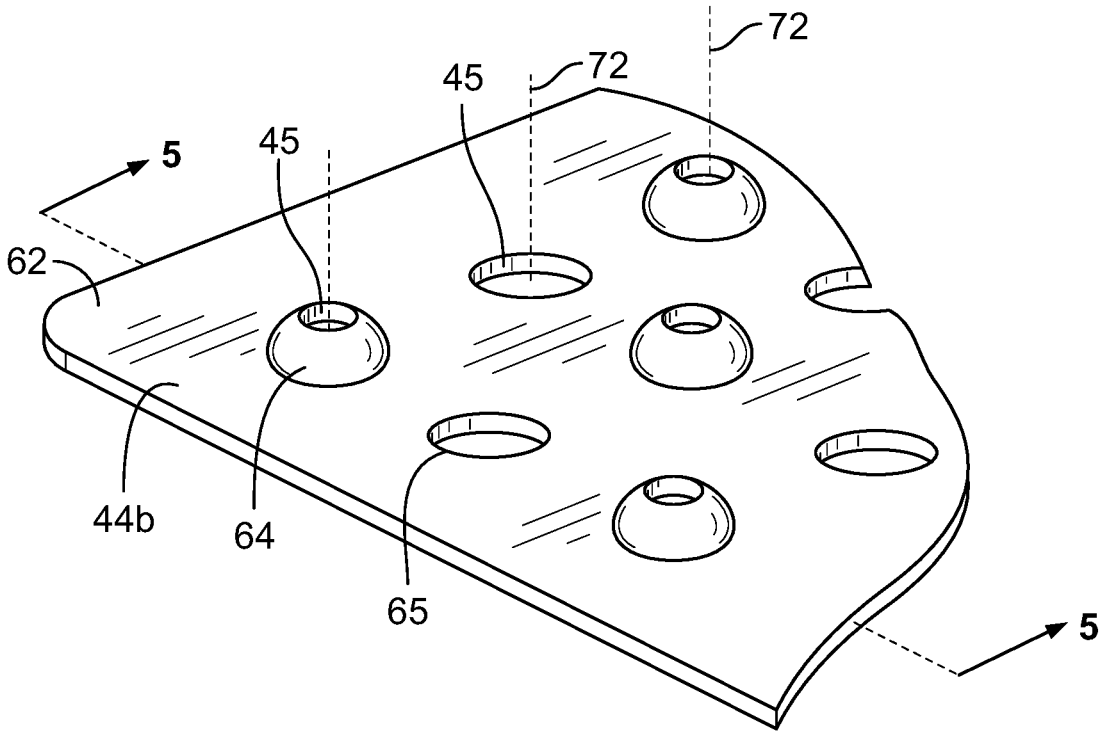
FIG. 4 is a perspective fragmentary view of one oven jet plate including both focused and diffuse jet openings.
Figure 5:
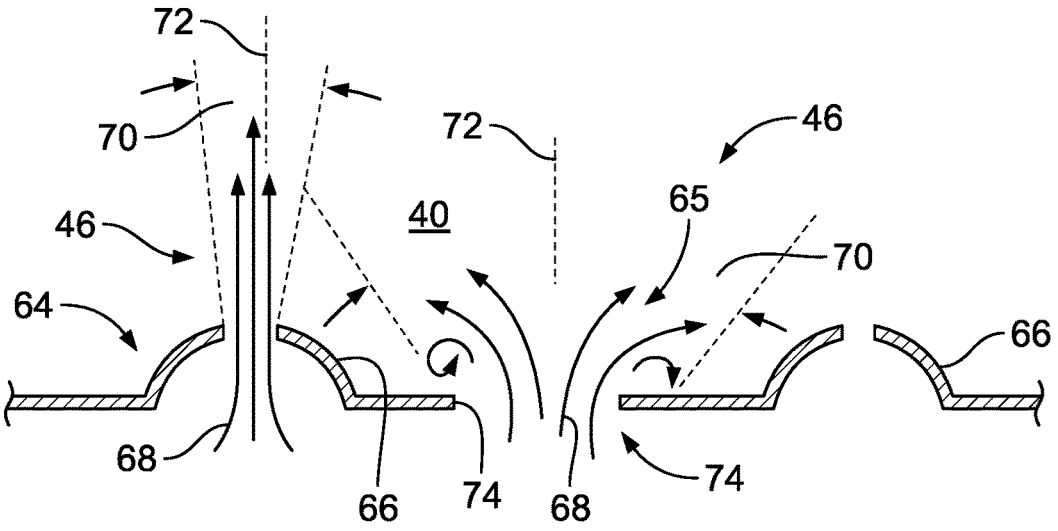
FIG. 5 is a cross-section taken along line 5-5 of FIG. 4 showing the airflow through the focused jets and diffuse jets.

Referring now to FIG. 4, each of the jet plates 44 may be substantially identical although flipped in orientation between the upper jet plate 44*a* to the lower jet plate 44*b*, and accordingly only one jet plate 44 will be described. Each jet plate 44 comprises a sheet metal surface 62 having a set of openings 45 as discussed above. Generally, these openings will be divided into openings that provide for focused jets 64 and openings that provide diffuse jets 65, each providing different characteristic jets 46. Referring now also to FIG. 5, the focused jets 64 provide an upwardly projecting dimple 66 producing a funnel shape that transitions the air 68 outside of the cooking cavity 40 into a focused jet 64 along a jet axis 72 with reduced turbulence. The result is a tight plume of air out of the narrow end of the funnel shape having a narrow dispersion angle 70, for example, less than 20°. In contrast, the diffuse jets 65 do not have a dimple but provide hole edges that are substantially perpendicular continuations of the sheet metal plate 62 and perpendicular to the jet axis 72. The sheet metal around the diffuse jets 65 produces an abrupt edge creating turbulence 74 tending to spread the air 68 as it passes into the cooking cavity with a dispersion angle, for example, greater than 30°. While the inventors do not wish to be bound by a particular theory, it is believed that the focused jets and diffuse jets interact close to the food to disperse the focus jets 64 near the end of the delivery of heat, striking a compromise between high-heat flow and focused heat flow.

Generally, the size of the openings providing for the diffuse jets 65 may be approximately 0.30 to 0.75 inches and less than 0.75 inches and greater than 0.30 inches and the size of the openings providing for the focus jets 64 approximately 0.07 to 0.5 inches and less than 0.5 inches. The size of the openings of the diffuse jets 65 may be larger and approximately three to ten times the size or surface area of the focus jets 64. The size of the openings of the focus jets 64 may be approximately three to ten times the thickness of the sheet metal plate 62 and at least three times the thickness of the sheet metal plate 62. The sheet metal may be 18 to 22 gauge steel having an approximate thickness of 0.03125 to 0.05 inches and approximately 0.0375 inches.

Figure 6:
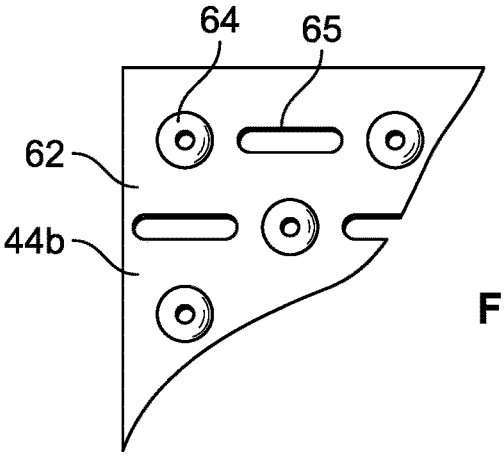
FIG. 6 is a top plan fragmentary view of an alternative jet plate to that of FIG. 4 using slot-shaped diffuse jets.

Referring now also to FIG. 6, it will be appreciated that the openings of the diffuse jets 65 need not be round but, for example, can be slots or a pattern of slots-and-dots (see FIG. 7) providing a similar size or surface area opening allowing flexible control of total air flow through the diffuse jet 65. Generally, the size of the diffuse jets 65 that are slots may be approximately 0.07 to 0.10 inches wide and 9.5 to 11 inches long and the size of the slots-and-dots may be slots approximately 0.07 to 0.10 inches wide and 9.5 to 11 inches long and dots approximately 0.10 to 0.13 inches and greater than 0.10 inches and larger than the width of the slots.

Referring now also to FIGS. 11A-11E, it will be appreciated that different patterns of diffuse jets 65 (round or slots or slots-and-dots) and focus jets 64 may be used in the sheet metal surface 62 with exemplary patterns being shown. For example, the sheet metal surface 62 may include alternating diffuse jets 65 (round) and focus jets 64 (FIG. 11A); alternating diffuse jets 65 (slots) and focus jets 64 (FIG. 11B); pattern of diffuse jets 65 (round), diffuse jets 65 (slots), and focus jets 64 (FIG. 1C); alternating diffuse jets 65 (slots-and-dots) and focus jets 64 (FIG. 11D); pattern of diffuse jets 65 (round), diffuse jets 65 (slots-and-dots), and focus jets 64 (FIG. 11E); and the like.

Figure 12:
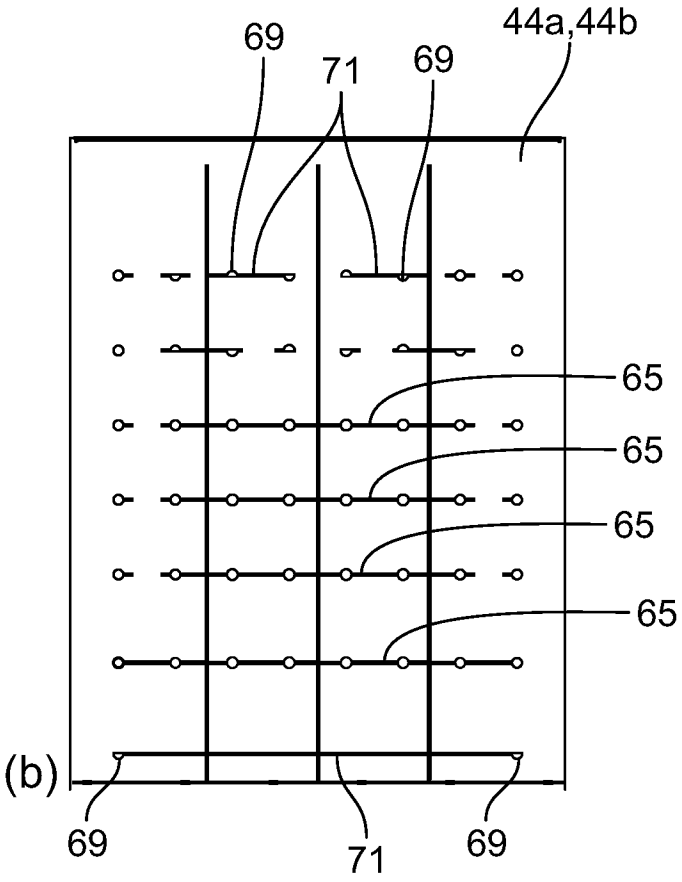
FIG. 12 is a top plan view of exemplary alternative jet plates to that of FIG. 4 using various patterns of slots and dots.
Figure 12:
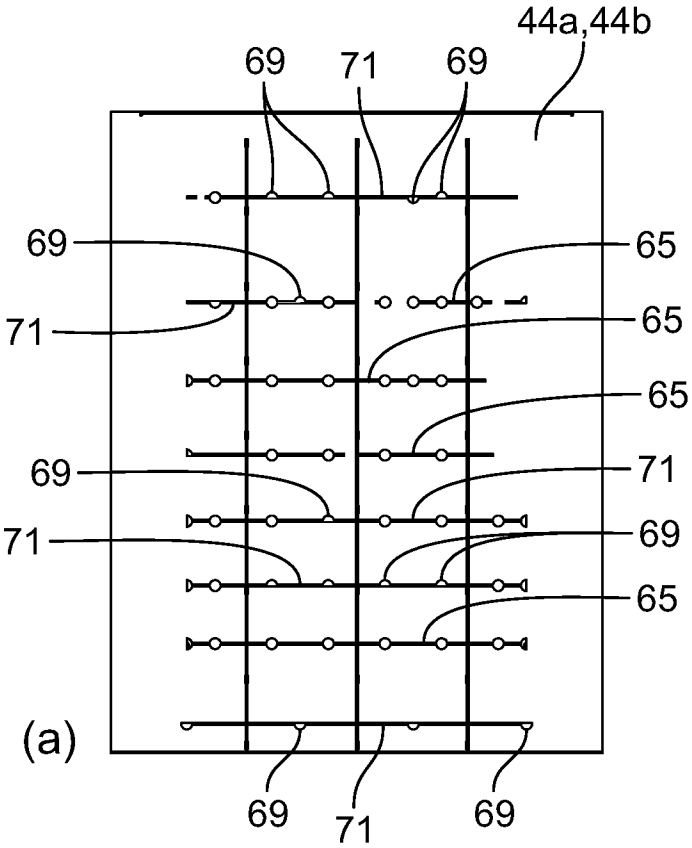

Referring to FIG. 12, the different patterns may also incorporate dot patterns that include half and quarter dots 69. For example, the invention may include hole patterns that are alternating slots 71 and half and quarter dots 69, or alternating diffuse jets 65 (slots-and-dots) and half and quarter dots 69. It is also contemplated that some of the slots 71 may be truncated or shortened so that they do not extend a full width of the jet plate 44.

As seen in the embodiment of FIG. 12*a*, the patterns may include front and rear edges of the jet plate 44 including primarily slots 71 and half and quarter dots 69, and a center portion of the jet plate 44 including combinations of diffuse jets 65 (slot-and-dots), slots 71, and half and quarter dots 69. As seen in the embodiment of FIG. 12*b*, the patterns may include front and rear edges of the jet plate 44 including primarily slots 71 and half and quarter dots 69, and a center portion of the jet plate 44 including primarily diffuse jets 65 (slot-and-dots).

The incorporation of half and quarter dots 69 and truncated slots 71 have been found to improve airflow and evenness of cooking in a similar manner as the focus jets 64. It is also understood that the upper jet plate 44*a* and lower jet plate 44*b* may include different hole patterns so that upward airflow and downward airflow patterns are different to provide more even cooking. In some embodiments, the support fins of the upper jet plate 44*a* or lower jet plate 44*b* may be eliminated.

Figure 13:
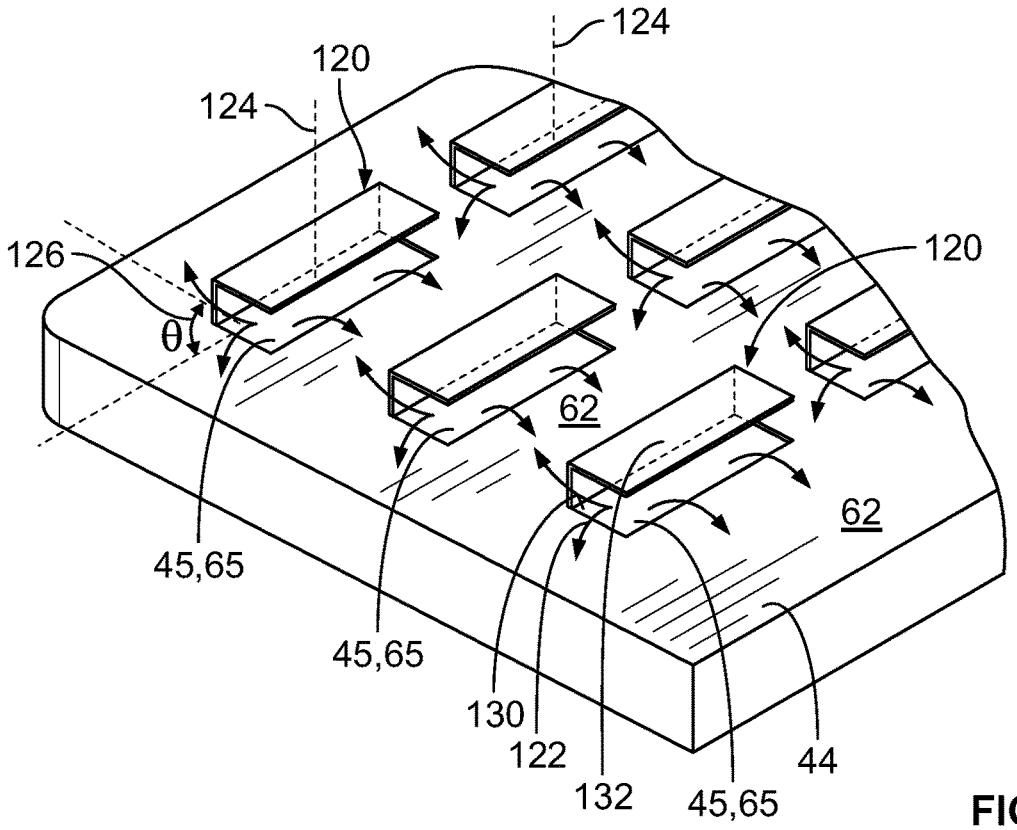
FIG. 13 is a partial side perspective view of jet plates with slots that include a first embodiment of deflectors for diverting the air leaving the slots over the surface of the jet plate.
Figure 14:
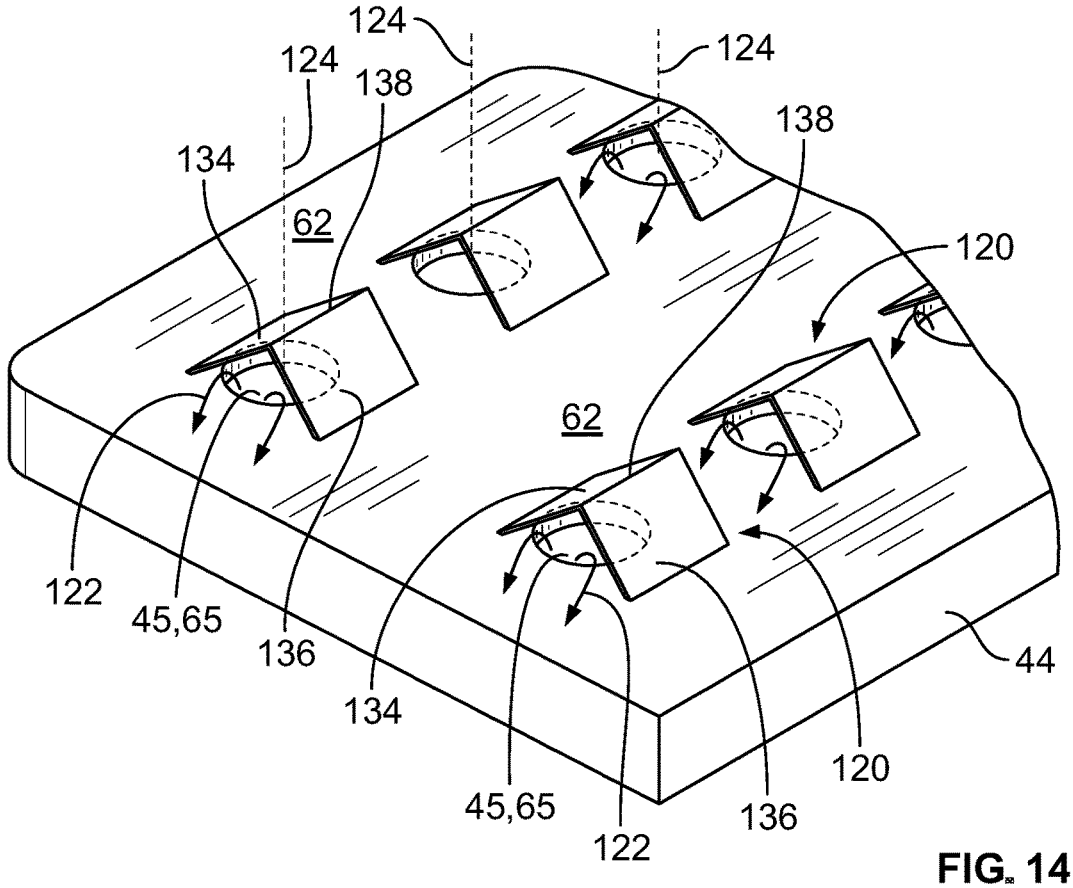
FIG. 14 is a partial side perspective view of jet plates with dots that include a second embodiment of deflectors for diverting the air leaving the dots over the surface of the jet plate.

Referring to FIGS. 13 and 14, the openings 45 of the diffuse jets 65 (round or slots or slots-and-dots) and/or focus jets 64 may further include metal diverters 120 which extend above the openings 45 and provide a diversion of air flow 122 from a generally upward direction along jet axis 124 along dispersion angles 126 from the sheet metal surface 62 of the jet plate 44, for example, that are greater than 30° and greater than 40° and greater than 50° and greater than 60° and greater than 70° and greater than 80°. While it is possible that the dispersion angles 126 may divert air perpendicular to the jet axis 72, it is understood that the diversion angles 126 may be between 0 and 90° from the jet axis 124. In this respect, the air flow 122 is diverted away from directly hitting the food product position on the jet plate 44 promoting more even cooking.

It is understood that all or some of the diffuse jets 65 (round or slots or slots-and-dots) and focus jets 64 on the jet plate 44 may include diverters 120 such that there is air flow 122 at dispersion angles 126 and air flow 122 along the jet axis 124. It is also understood that the diverters 120 may be present on the openings 45 of the upper surface or lower surface but is generally described herein as present on the upper surface of the jet plate 44 on which food is cooked.

Referring specifically to FIG. 13A, in one embodiment, the diverters 120 may take the shape of L-shaped overhangs with a vertical wall 130 extending upwardly from one side of the diffuse jets 65 (round or slots or slots-and-dots) and/or focus jets 64, and a horizontal wall 132 extending horizontally from the top of the vertical wall 130 and over the diffuse jets 65 (round or slots or slots-and-dots) and/or focus jets 64 to substantially overlap the openings 45. In this respect the horizontal wall 132 may be similarly sized and shaped as the openings 45. The vertical wall 130 and horizontal wall 132 may be angled to permit air flow 122 to be diverted at certain desired angles. For example, horizontal wall 132 may be angled upwardly to divert air flow 122 in an upward angle.

Referring specifically to FIG. 13B, in an alternative embodiment, the diverters 120 may take the form of inverted V-shaped "tents" with first and second angled rectangular walls 134, 136 flanking the opposite sides of the diffuse jets 65 (round or slots or slots-and-dots) and/or focus jets 64 and joining at a top edge 138. The first and second angled walls 134, 136 are angled to permit air flow 122 to be diverted at certain angles by deflecting off the inner surface of the first and second angled walls 134, 136.

In certain embodiments, the diverters 120 may divert air flow 122 toward other diverters 120 on the jet plate 44 to create a deflection of air flow 122 off multiple diverters 120 and dispersing over the sheet metal surface 62 of the jet plate 44. In this respect, the diverters 120 interact with each other to provide a deflection of air flow 122 that is more uniform than without the diverters 120 thus minimizing burn marks on the food occurring when the heated air jets directly hit the food.

It is understood that although exemplary embodiments of the diverters 120 are described above, the diverters 120 may take many different shapes and forms and are generally used to obstruct upward air flow 122 solely along the jet axis 124 but to divert air along different angles with respect to the jet axis 124 thus creating more even heated air flow 122 hitting the food for more even cooking.

Steam cooking may be introduced into each cavity 40. A steam generator system may introduce steam into selective cooking cavities 40 according to an electric signal associated with each cavity and a set of fans circulates air independently through the cooking cavities in isolation from the other cooking cavities. In addition, each cavity 40 provides a separate heater and a thermal sensor. A controller receives user commands to independently set temperature and humidity of the different cooking cavities. Steam cooking ovens are described, for example, in U.S. Pat. No. 10,684,022 assigned to the assignee of the present invention and hereby incorporated by reference.

Each cavity 40 may further introduce additional microwave or radiant enhancement to assist with high speed cooking within the cavity 40. For example, selective cooking cavities 40 may support a self-contained and independently operable magnetron tube or solid state microwave generator to send microwave radiation through the food product thus rotating and agitating the molecules within the food product. Electrical signals may be sent to the magnetron tube or solid state microwave generators according to a cooking schedule or user commands in order to operate the microwave elements thus speeding up the cooking rates of convection cooking, steam cooking and/or air impingement cooking.

Further, infrared radiant heating elements may be introduced into selective cooking cavities 40 to send infrared radiation to food product from nearby heating elements, such as calrod heaters, also agitating the molecules within the food product to speed up cooking. Electrical signals may be sent to the radiant heating elements according to a cooking schedule or user commands in order to operate the heating elements thus speeding up the cooking rates of convection cooking, steam cooking and/or air impingement cooking.

Additionally, a high thermal mass material such as cast iron or ceramic blocks may be introduced into selective cooking cavities 40 to provide heat transfer through radiant heat released to food placed on or near the high thermal mass material. The high thermal mass material may absorb heat from heating elements of the cavity 40 described herein or may be placed nearby auxiliary heating elements controlled by electrical signals according to a cooking schedule or user commands in order to operate the heating elements thus speeding up the cooking rates of convection cooking, steam cooking and/or air impingement cooking.

Speed cooking ovens are described, for example, in U.S. Pat. No. 10,599,391 and U.S. application Ser. No. 17/840,059 assigned to the assignee of the present invention and hereby incorporated by reference.

Figure 7:
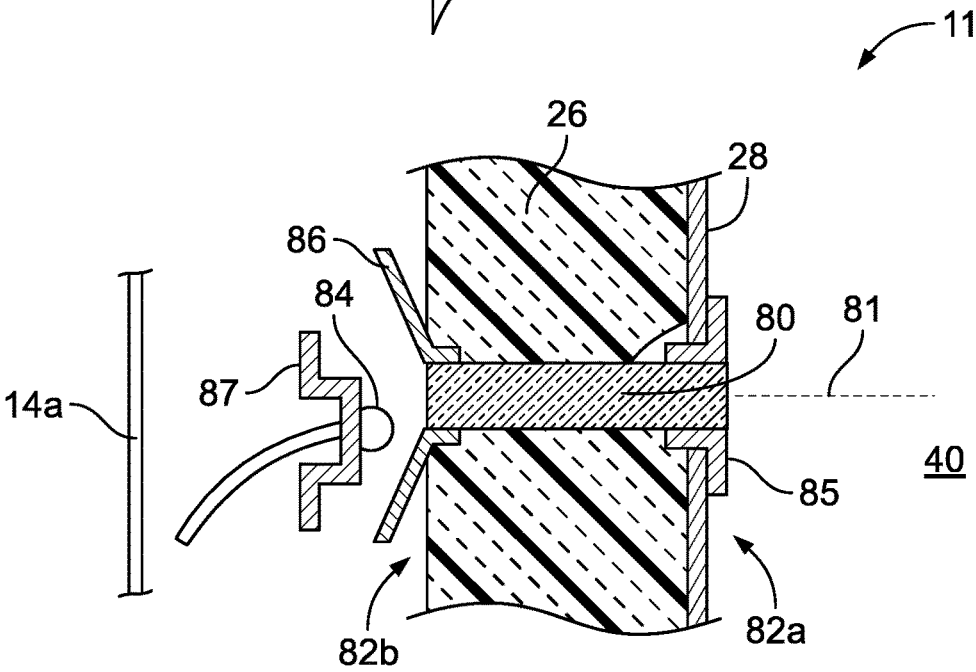
FIG. 7 is a cross-section through the insulation layer of FIGS. 1 and 3 and showing a light pipe for conducting high-efficiency LED light to the oven interior.

Referring now to FIGS. 1 and 7, illumination may be provided in the cooking cavity 40 through the cavity inner housing thermal insulation by means of an illumination assembly 113 having a light pipe 80 passing through the thermal insulation 26 near the sidewalls 14*a* and 14*b* from a proximal end 82*a* of the light pipe 80 opening into the oven cavity 40. A distal end 82*b* of the light pipe 80 outside of that thermal insulation 26 receives light from a light emitting diode (LED) 84 thermally isolated from the light pipe 80, for example, with an air gap. The principal light emitting axis of the LED is directed to the end 82*b* along an axis 81 to pass into the light pipe 80 into the cooking cavity 40. In this regard end 82*a* and end 82*b* may be essentially perpendicular to the axis 81 to promote the coupling of light into the light pipe 80 through Snell's law.

To minimize heat conduction through the light pipe 80 which may, for example, be a glass such as a borosilicate glass, the light pipe 80 may be insulated from the cavity inner housing 28 by an insulating silicone rubber grommet 85 or the like. In addition, a heatsink 86 may be placed in contact with the end 82*b* to conduct heat away from the LED 84 which may be supported with its own heatsink 87 separated from heatsink 86. In this way high-efficiency LED lighting can be used despite the high temperature of the oven without extensive modification of the cavity inner housing 28 other than providing the necessary openings therethrough. Alternatively, the light pipes 80 may be a tube with internal reflecting surfaces or the like covered with a glass window.

Figure 8:
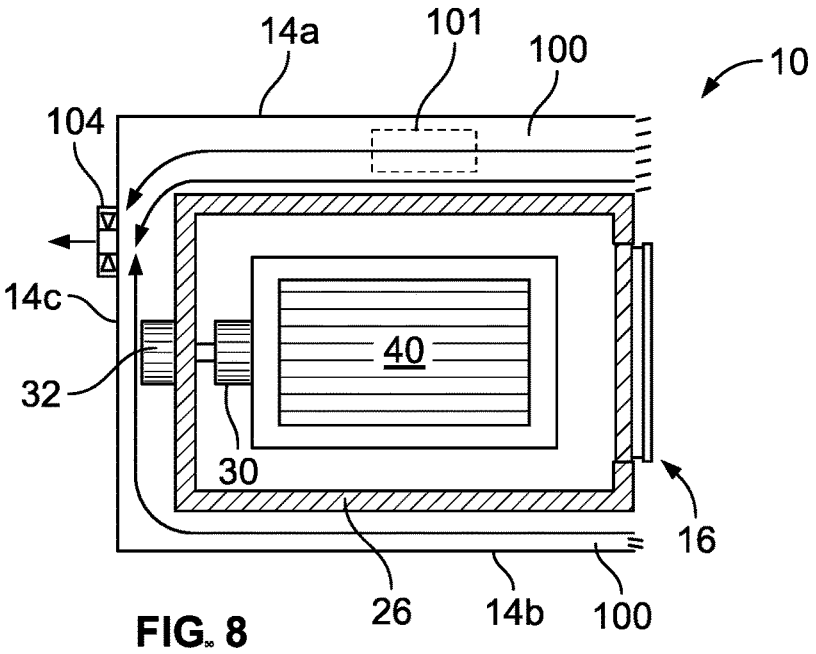
FIG. 8 is a figure similar to that of FIG. 3 showing an outer housing of the oven providing for cooling airflow along the sidewalls.
Figure 9:
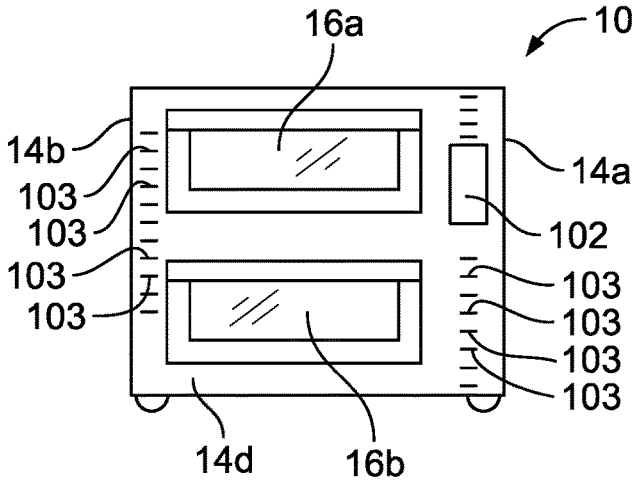
FIG. 9 is a front elevational view of the oven of FIG. 8 showing air inlet vents.

Referring now to FIGS. 8 and 9, an air conduit space 100 may be provided between the oven sidewalls 14 and the adjacent thermal insulation 26 and between sidewall 14*b* and the adjacent thermal insulation 26 to receive air from air vents 103 at the front of the oven and to conduct that air along the air conduit space 100 rearwardly to exit out of a rear sidewall 14 of the oven, for example, as driven by a brushless permanent magnet fan 104 having a central motor surrounded by an impeller. The low temperature of this air is ensured by ample flow rate at low pressure and serves to scavenge heat flowing from the cooking cavity 40 outward through the sidewalls 14*a* or 14*b* thus allowing the oven to be placed adjacent to other equipment without concern for overheating. The air conduit space 100 may also hold sensitive electronics 101 as will be discussed further below with respect to FIG. 10.

Figure 10:
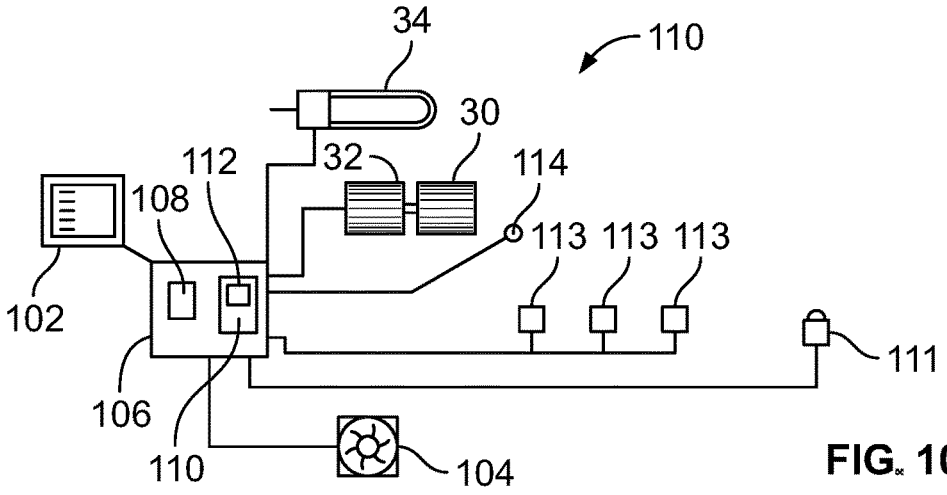
FIG. 10 is a simplified schematic diagram of the control system of the oven of FIG. 1.
Figure 11A:
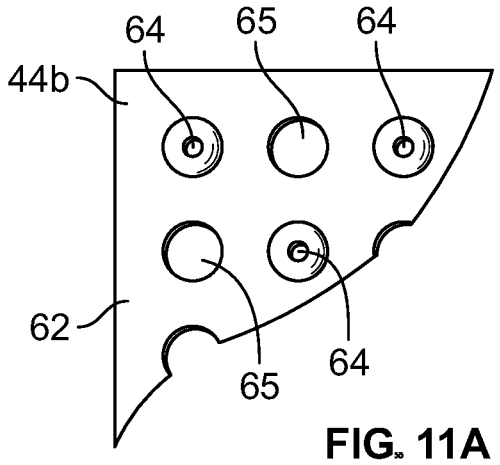
FIGS. 11A-11E are top plan fragmentary views of exemplary alternative jet plates to that of FIG. 4 using various patterns of forced jets and diffuse jets.
Figure 11B:
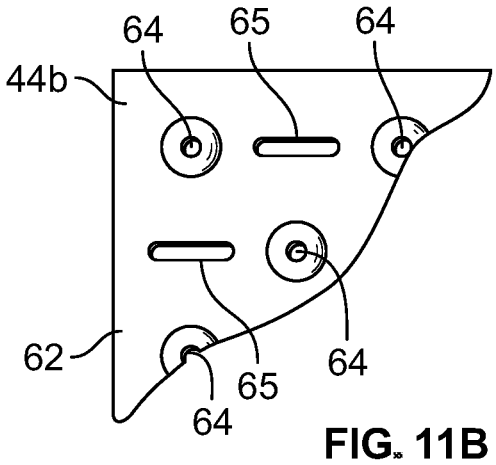
Figure 11C:
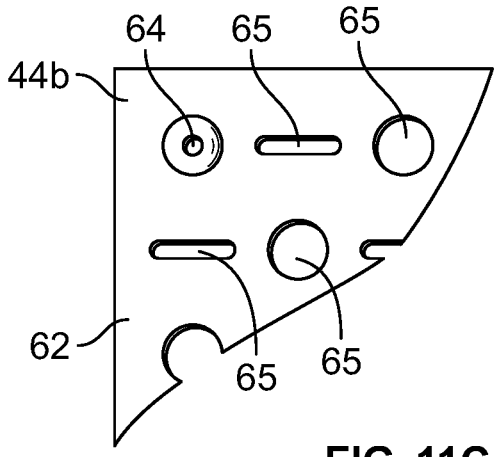
Figure 11D:
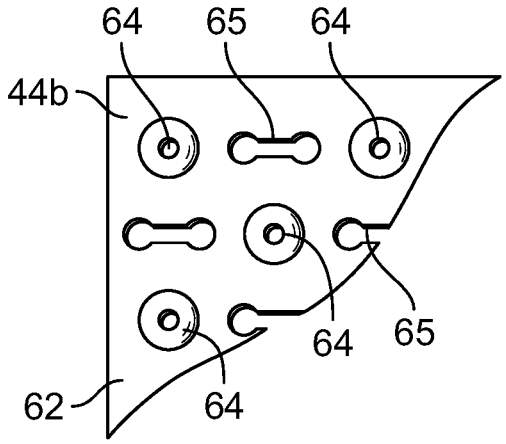
Figure 11E:
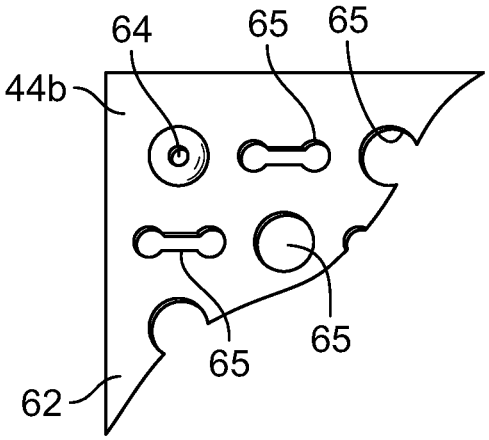

Referring now to FIG. 10, the oven 10 may provide for an electronic controller 106 communicating with the touchscreen 102 or the like to allow for control of the temperature of the cooking cavities 40 of the oven 10. The electronic controller 106 may include one or more processors 108 communicating with electronic memory 110 holding a stored program 112 providing the operations discussed herein. In addition, electronic controller 106 may communicate with the fan motor 32 and the heaters 34 according to temperature received from a temperature sensor 114 within the oven cavity 40 and providing oven temperature control according to temperatures entered in the touchscreen 102. During operation of the oven 10 under thermostatic control, the controller 106 may also communicate with the fan 104 to activate cooling of the outer walls of the oven 10. A door switch 111 may be used to signal the controller 106, for example, to make up heat after the door has been opened and turn on one or more of the LED light assemblies 113 during operation or under control of the user.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom", and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including", and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" and "a processor" or "the microcontroller" and "the processor," can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What we claim is:

1. An oven comprising:

at least one oven cavity sealable by a door to provide a lower sheet metal wall and opposed upper sheet metal wall separated by vertical sidewalls including a sidewall formed by the door, the upper wall providing an upper plenum receiving air at a plenum entrance and conducting that air to a plurality of disconnected openings distributed over a lower surface of the upper plenum, and the lower wall providing a lower plenum receiving air at a plenum entrance and conducting that air to a plurality of disconnected openings distributed over an upper surface of the lower plenum;

a fan receiving air from the air cavity and blowing the air into the plenum for discharge through the openings of the upper sheet metal wall and lower sheet metal wall;

a heater for heating the air before discharge through the openings; and wherein the disconnected openings of the upper sheet metal wall and lower sheet metal wall include smaller jet openings and separate larger jet openings, where the smaller jet openings promote a first airflow narrower than a second airflow through the separate larger jet openings.

2. The oven of claim 1 wherein the sheet metal at the smaller jet openings is deformed to extend along an axis of airflow through the smaller jet openings and funnel-shaped converging at the smaller jet opening and wherein the sheet metal at the larger jet openings is substantially perpendicular to an axis of air flow through the larger jet openings.

3. The oven of claim 1 wherein the larger jet openings are interspersed among the smaller jet openings.

4. The oven of claim 1 wherein the larger jet openings are slots.

5. The oven of claim 1 wherein the larger jet openings and the smaller jet openings have a radius at least three times a thickness of the sheet metal.

6. An oven comprising:

at least one oven cavity sealable by a door to provide a lower sheet metal wall and opposed upper sheet metal wall separated by vertical sidewalls including a sidewall formed by the door, the upper wall providing an upper plenum receiving air at a plenum entrance and conducting that air to a plurality of openings distributed over a lower surface of the upper plenum, and the lower wall providing a lower plenum receiving air at a plenum entrance and conducting that air to a plurality of openings distributed over an upper surface of the lower plenum;

a fan receiving air from the air cavity at a fan inlet and blowing the air into the plenum at a fan outlet for discharge through the openings into the oven cavity;

a heater for heating the air before discharge through the openings; and an air return air conduit communicating between intake openings proximate to the sidewall formed by the door and one of the lower sheet metal wall and upper sheet metal wall to operate in conjunction with discharge openings in another of the lower sheet metal wall and upper sheet metal wall discharging air into the oven cavity to provide an air curtain limiting an escape of hot air from the oven cavity when the door is open.

7. The oven of claim 6 wherein the intake openings are in the lower sheet metal wall.

8. The oven of claim 6 wherein the air return conduit passes along an oven sidewall.

9. The oven of claim 6 further including a valve actuated by the door to block the intake openings when the door is closed.

10. The oven of claim 6 wherein the sheet metal at the discharge openings is deformed to extend along an axis of air flow through the discharge openings to promote focused airflow.

11. An oven comprising:

at least one oven cavity sealable by a door to provide a lower sheet metal wall and opposed upper sheet metal wall separated by vertical sidewalls including a sidewall formed by the door, the upper wall providing an upper plenum receiving air at a plenum entrance and conducting that air to a plurality of openings distributed over a lower surface of the upper plenum, and the lower wall providing a lower plenum receiving air at a plenum entrance and conducting that air to a plurality of openings distributed over an upper surface of the lower plenum;

an oven housing surrounding the oven cavity and providing upstanding sidewalls spaced from the vertical sidewalls of the oven cavity to define an active insulation conduit therethrough;

a first fan receiving air from the air cavity at a fan inlet and blowing the air into the plenum at a fan outlet for discharge through the openings into the oven cavity;

a heater for heating the air before discharge through the openings; and a second fan communicating with the active insulation conduit to draw ambient air rearward therethrough to scavenge heat received by the active insulation conduit.

12. The oven of claim 11 further including intake openings to the active insulation conduit positioned at a front of the oven housing proximate to the door whereby the second fan draws air from a front of the oven housing and discharges the air at a rear of the oven housing.

13. The oven of claim 11 further including an insulating fiber material positioned between the vertical sidewalls of the oven cavity and the active insulation conduit.

14. The oven of claim 11 wherein the second fan provides a motor positioned within airflow generated by the fan.

15. An oven comprising:

at least one oven cavity sealable by a door and providing opposed lower and upper walls separated by vertical sidewalls including a sidewall formed by the door;

a heater communicating with the oven cavity to controllably provide cooking temperatures in excess of 350° F.;

thermal insulation positioned around the oven cavity;

a light pipe having a first end exposed in the oven cavity and a second end exposed outside of the thermal insulation; and a LED positioned to direct light into the first end of the light pipe; whereby the LED is insulated from a high temperature of the oven cavity;

wherein the second end is attached to a first heatsink dispersing heat from the second end;

wherein the LED is attached to a second heatsink separate from the first heatsink.

16. An oven comprising:

at least one oven cavity sealable by a door to provide a lower sheet metal wall and opposed upper sheet metal wall separated by vertical sidewalls including a sidewall formed by the door, the upper wall providing an upper plenum receiving air at a plenum entrance and conducting that air to a plurality of openings distributed over a lower surface of the upper plenum, and the lower wall providing a lower plenum receiving air at a plenum entrance and conducting that air to a plurality of openings distributed over an upper surface of the lower plenum;

a fan receiving air from the air cavity and blowing the air into the plenum for discharge through the openings of the upper sheet metal wall and lower sheet metal wall;

a heater for heating the air before discharge through the openings; and wherein the openings of the upper sheet metal wall and lower sheet metal wall include more than one jet opening promoting air along an axis of airflow; and at least one diverter positioned to extend across the axis of airflow of the more than one jet opening to promote airflow away from the axis of airflow of the more than one jet opening.

17. The oven of claim 15 wherein the light pipe is a straight glass rod extending along an axis between the first end and second end, and the first end and second end present surfaces perpendicular to that axis.

18. The oven of claim 15 wherein the LED is spaced from the second end by an air gap.

* * * * *